United States Patent [19]

Guimont

[11] Patent Number: 4,871,069

[45] Date of Patent: Oct. 3, 1989

[54] CUSHIONED CONTAINER

[76] Inventor: Patricia A. Guimont, 2543 W. Catalina Dr., Phoenix, Ariz. 85017

[21] Appl. No.: 161,907

[22] Filed: Feb. 29, 1988

[51] Int. Cl.[4] ..... A45C 11/20; B65D 81/38

[52] U.S. Cl. ..... 206/545; 5/448; 190/1; 190/8; 206/547; 220/3.1; 220/23.83; 222/31; 222/192; 222/522; 297/192; 383/4; 383/110

[58] Field of Search ..... 5/448, 442; 190/1, 8; 383/4, 110, 901, 906; 206/547, 545, 544; 220/3.1, 408, 412, 23.83; 297/192; 222/522, 131, 183, 192; 62/371; 215/13.1

[56] References Cited

U.S. PATENT DOCUMENTS

| | | | |
|---|---|---|---|
| 2,123,031 | 7/1938 | Weiner | 206/545 |
| 3,223,117 | 12/1965 | Curie et al. | 222/183 |
| 3,395,550 | 8/1986 | Dungan | 62/371 |
| 3,435,990 | 4/1969 | Pike, Jr. | 222/183 |
| 3,613,872 | 10/1971 | Donnelly | 206/545 |
| 3,763,972 | 10/1973 | Karzmar | 190/8 |
| 4,228,908 | 10/1980 | Tweeton | 206/545 |
| 4,533,050 | 8/1985 | Bake, Jr. | 206/545 |

*Primary Examiner*—Alexander Grosz
*Attorney, Agent, or Firm*—Harry M. Weiss

[57] ABSTRACT

A seat cushion comprising a cushioned container for use in carrying a plurality of different fluids is provided. The container has a seat cover which has a cushioning material that encloses a plurality of container cavities for the fluids. The container cavities have respective telescoping spigots, which extend outside the seat cover, for drawing off a desired beverage from a selected container cavity. The seat cover has an optional handle for carrying the seat cushion.

1 Claim, 1 Drawing Sheet

CUSHIONED CONTAINER

BACKGROUND OF THE INVENTION

1. Field of the Invention

The invention generally relates to a cushioned container and, in particular, the invention relates to a cushioned container for use as a seat cushion.

2. Description of the Related Art

A prior art container having a protective package is described in U.S. Pat. No. 4,114,759, issued Sept. 19, 1978. Related patents include U.S. Pat. Nos.:

2,891,984, issued May 2, 1961;
3,347,354, issued Oct. 17, 1967;
3,587,794, issued June 28, 1971;
3,904,058, issued Sept. 9, 1975;
3,929,227, issued Dec. 30, 1975;
3,987,736, issued Oct. 26, 1976; and
4,699,282, issued Oct. 13, 1987.

The above noted prior art container package arrangement includes a rigid outer package and a bottle enclosed by the rigid outer package.

One problem with the prior art container package arrangement is that the rigid outer package is not suitable for use as a cushioned seat.

SUMMARY OF THE INVENTION

According to the present invention, a cushioned container is provided. The cushioned container includes a seat cover, resilient insulating material disposed inside the seat cover, and at least one container enclosed by the resilient insulating material.

By using the seat cover and the resilient insulating material, the cushioned container overcomes the prior art problem of not being able to use the prior art packaged container as a cushioned seat.

The foregoing and other objects, features and advantages will be apparent from the following description of the preferred embodiment of the invention as illustrated in the accompanying drawings.

DESCRIPTION OF THE PREFERRED EMBODIMENTS

Figure 1:
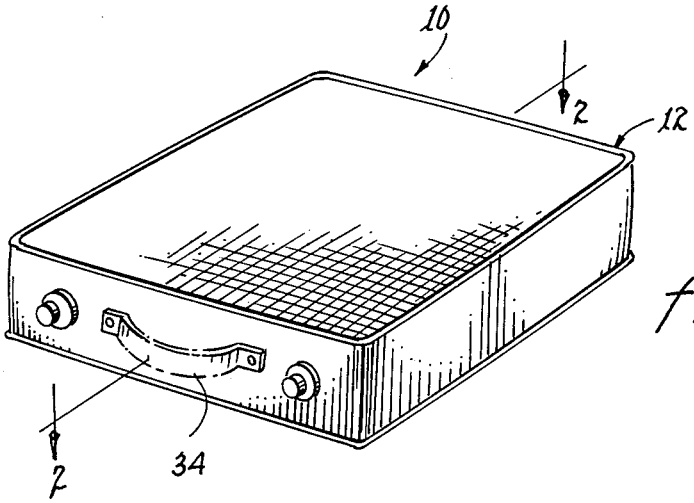
FIG. 1 is a perspective view of a cushioned container according to the invention.
Figure 2:
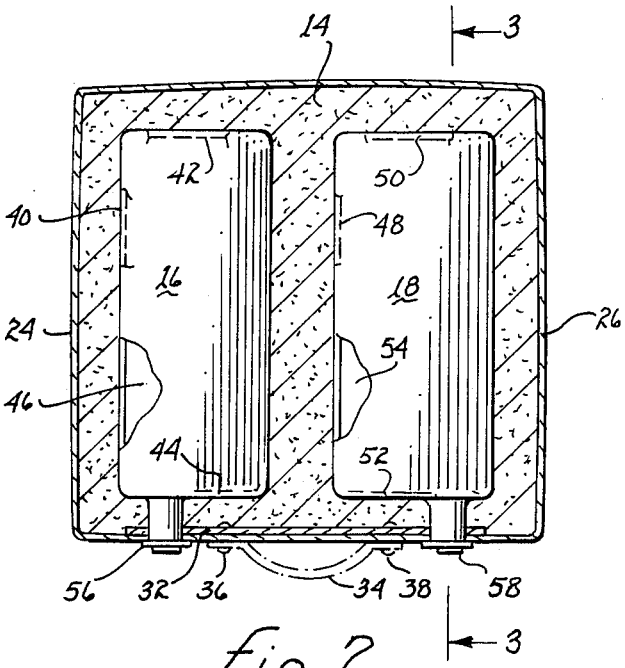
FIG. 2 is a section view as taken along the line 2—2 of FIG. 1.

As shown in FIGS. 1 and 2, a cushioned container 10 is provided. Container 10 includes a seat cover 12, resilient insulating material 14 which is disposed inside seat cover 12, and a plurality of container cavities 16, 18 are preferably molded in resilient insulating material 14. The molding is more resistant to breakage than almost all other container constructions.

Figure 3:
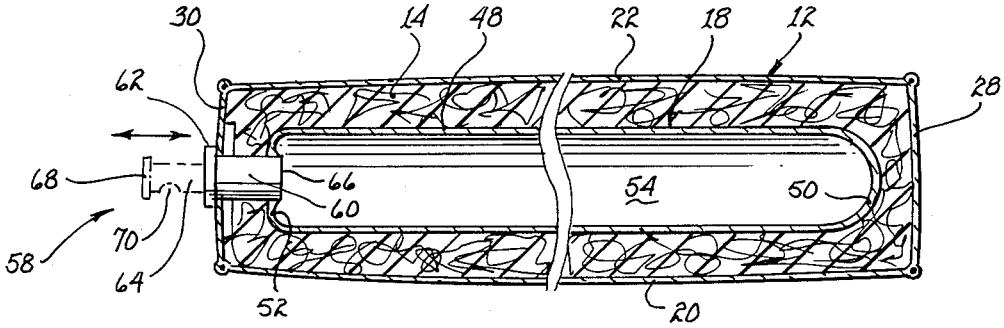
FIG. 3 is a section view as taken along the line 3—3 of FIG. 2.

As shown in FIGS. 2 and 3, seat cover 12 has a lower wall 20, an upper wall 22, a left side wall 24, a right side wall 26, a rear wall 28, and a front wall 30. Front wall 30 has a reinforcing member 32, and a handle or hand strap 34 which has a pair of rivets 36, 38. Each of the rivets 36, 38 extends through strap 34, wall 30, and member 32. Strap 34, which is optional, is shown in dashed lines in the figures.

Container cavity 16 has a peripheral wall 40, a rear wall 42, and a front wall 44, which together form an inner cavity 46. Container cavity 18 also has a peripheral wall 48, a rear wall 50, and a front wall 52, which together form an inner cavity 54.

Walls 40, 42, 44, 48, 50, 52 are preferably composed of a resilient leak-proof material. Cavities 46, 54 contain either the same or different types of fluids, as desired.

Container cavity 16 has a spigot means 56. Container cavity 18 also has a spigot means 58. Spigot means 56 which is identical to spigot means 58, is preferably a telescopic type of spigot means which is not detectable from outside view when spigot means 56 and 58 are retracted.

Spigot means 58 includes an outer tubular member 60 (see FIG. 3) which has a flanged portion 62, and includes an inner tubular member 64 which is received in outer tubular member 60. Outer tubular member 60 has an inner end portion 66, which is fixedly connected to front wall 52 of bottle or container cavity 18. End portion 66 extends through front wall 52 and opens into cavity 54 and forms a leak-proof connection to wall 52. Inner tubular member 64 has a disk shaped, end wall 68 and has an opening 70. Opening 70 in its open position permits fluid flow from cavity 54, through inner tubular member 64, and out through opening 70. Opening 70 in its closed position prevents fluid flow.

Figure 4:
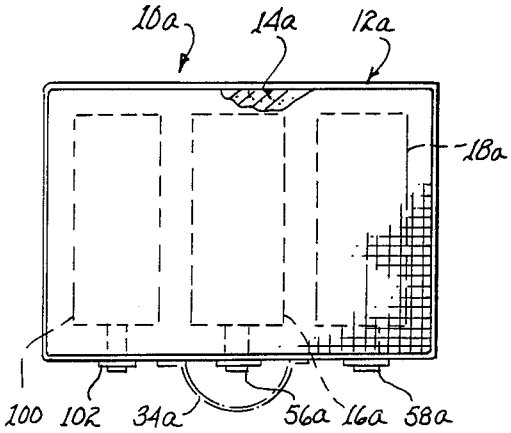
FIG. 4 is a top view of an alternate embodiment of a cushioned container according to the invention.

In FIG. 4, an alternate embodiment of cushioned container 10*a* is shown. Parts of container 10*a* which correspond to parts of container 10 have the same numerals, but with a subscript "a" added thereto.

Cushioned container 10*a* includes a seat cover 12*a*, resilient insulating material 14*a*, and a plurality of container cavities, namely three container cavities 16*a*, 18*a*, 100, are provided which are preferably identical in construction. Container cavity 16*a* has a spigot means 56*a*, and container cavity 18*a* has a spigot means 58*a*, and container cavity 100 has a spigot means 102. Cushioned container 10*a* also has an optional hand strap 34*a*.

With the construction of cushioned container 10*a*, an additional container cavity 100 is provided, so that a third type of liquid or more of the same liquid can be stored and dispensed from container 10*a*, as desired.

The advantages of cushioned container 10, and also of cushioned container 10*a*, are indicated hereafter.

1. Cushioned container 10, which contains a suitable seat cover 12 and a resilient material 14, is well suited for use as a cushioned seat.

2. Cushioned container 10, which contains a plurality of container cavities 16, 18 and insulating material 14, can carry a plurality of different or similar fluids as desired.

3. Cushioned container 10 has the appearance and the function of a seat cushion. Spigots 56, 58, 102 in their closed positions appear to be metal disk-shaped members on the cushion and thus do not otherwise affect the cushion appearance.

While the invention has been described in its preferred embodiments, it is to be understood that the words which have been used are words of description rather than limitation and that changes may be made within the purview of the appended claims without departing from the true scope and spirit of the invention in its broader aspects.

For example, walls 48, 50, 52 can be molded portions of a material 14. Material 14 can be a suitable moldable material so that internally molded cavity regions around cavities 46, 54 would be formed, for use in containing different types of fluids or beverages.

I claim:

1. A portable seat cushion comprising:

a seat cover;

a resilient thermal insulting material within said seat cover, said material being molded to form at least one cavity having inn®r walls that are impermeable to fluids; and a spigot connected to a wall of said cavity, said spigot having an outer tubular member and a telescoping inner tubular member that extends through said seat cover, said inner tubular member being alternatively moveable to an open position and to a closed position to respectively permit and prevent a flow of fluid from said cavity through said tubular members to the outside of said seat cover.

* * * * *